US005202210A

United States Patent [19]

Matsuoka et al.

[11] Patent Number: 5,202,210

[45] Date of Patent: Apr. 13, 1993

[54] CARRIER FOR MAGNETIC BRUSH DEVELOPER

[75] Inventors: Hirotaka Matsuoka; Masanori Ichimura; Masaru Miura, all of Kanagawa, Japan

[73] Assignee: Fuji Xerox Co., Ltd., Tokyo, Japan

[21] Appl. No.: 775,834

[22] Filed: Oct. 15, 1991

[30] Foreign Application Priority Data

Nov. 22, 1990 [JP] Japan ..... 2-316071

[51] Int. Cl.[5] ..... G03G 9/107; G03G 9/113

[52] U.S. Cl. ..... 430/106.6; 430/108; 428/407

[58] Field of Search ..... 430/106.6, 108; 428/407

[56] References Cited

U.S. PATENT DOCUMENTS 4,954,409 9/1990 Aoki et al. ..... 430/108

FOREIGN PATENT DOCUMENTS 50543 3/1985 Japan ..... 430/108

157168 6/1988 Japan ..... 430/108

*Primary Examiner*—Roland Martin

*Attorney, Agent, or Firm*—Finnegan, Henderson, Farabow, Garrett & Dunner

[57] ABSTRACT

A carrier for magnetic brush developer comprising a core material having coated thereon a coated layer containing a graft copolymer comprising a polymer of a nitrogen-containing vinyl monomer or a phosphorus-containing vinyl monomer having a molecular weight of from 1,000 to 5,500 graft-copolymerized thereto a vinyl monomer.

6 Claims, No Drawings

CARRIER FOR MAGNETIC BRUSH DEVELOPER

FIELD OF THE INVENTION

The present invention relates to a carrier for magnetic brush developer used together with a toner for developing an electrostatic charged image formed by an electrophotographic method, an electrostatic printing method, an electrostatic recording method or the like. Particularly, the present invention relates to a coated carrier for magnetic brush developer having a coated layer on the surfaces of a core material.

BACKGROUND OF THE INVENTION

In the electrophotographic methods, a method generally employed is to firstly form an electrostatic latent image using various means by using a photoconductive material, such as selenium, as a light sensitive medium, and a toner is adhered to this electrostatic latent image using a magnetic brush development method to develop the latent image.

In the magnetic brush development methods, carriers used for imparting a suitable amount of positive or negative charge to the toner are generally classified into coated carriers and noncoated carriers. The coated carriers are superior when considering the life of a developer, and therefore various types of coated carriers have been developed and used in practice.

Various properties are required in coated carriers, and the particularly important include suitable charging property, impact resistance, wear resistance, good adherence between the core material and the coated layer, and uniformity of charge distribution.

In view of the above requirements, conventional coated carriers have always had problems and required improvements, and no perfected products are known at present. For example, it has been proposed to use fluorinated vinyl polymers as a coated layer material either singly or blended with acrylic monomers. However, the fluorine polymers are deficient in the capacity to charge a toner negatively because of the strongly negative electric negativity of fluorine itself, although it is superior in surface contamination resistance. These characteristics of the fluorine polymers are particularly conspicuous under high temperature and high humidity. Consequently, carriers with an amount of fluorine polymer sufficient for surface contamination resistance either singly or blended at high concentrations with acrylic polymers were low in charging properties, and there were difficulties in reconciling contamination versus the amount of charge under high temperature and high humidity.

Also, carriers coated with the fluorine polymers have slow build-up speeds in their charges under low temperature and low humidity, and have the further defect of poor charge exchangeability between toners and carriers. This defect is conspicuous when they are used in combination with a color toner or a toner having a small particle size, and in practice, there may be problems such as contamination inside the copying machines.

SUMMARY OF THE INVENTION

An object of the present invention is to provide a carrier for magnetic brush developer that has superior surface contamination resistance, gives a charge with good environmental dependence, has a fast charge build-up speed, and has superior charge exchangeability.

Other objects and effects of the present invention will be apparent from the following description.

As the result of various investigations for removing the defects in prior art technology, the present inventors have perfected in the present invention based on the finding in that the properties required for coated carriers will be improved by using a specific material for the coated layer.

The present invention provides a carrier for magnetic brush developer comprising a core material having coated thereon a coated layer containing a graft copolymer comprising a polymer of a nitrogen-containing vinyl monomer or a phosphorus-containing vinyl monomer having a molecular weight of from 1,000 to 5,500 graft-copolymerized thereto a vinyl monomer.

DETAILED DESCRIPTION OF THE INVENTION

Known magnetic materials can be used as the core materials in the present invention. Examples thereof include magnetic metals such as iron, steel, nickel and cobalt, and magnetic oxides such as ferrite and magnetite. The average particle diameter of the core material used is generally from 10 to 500 μm, and preferably 30 μm to 150 μm.

While the core material is provided with the coated layer on its surface, an intermediate layer comprising nitrogen-containing silane coupling agent represented by formula (I) below may be provided between the core material and the coated layer:

$$R\text{-}Si(OX)_3 \qquad (I)$$

wherein X represents a hydrolyzable group, such as a methyl group or an ethyl group, and R represents an alkyl group containing 3 or more carbon atoms and 1 or more nitrogen atoms.

Specific examples of the nitrogen-containing silane coupling agent include the following:

$H_2NCH_2CH_2CH_2Si(OCH_3)_3$ $H_2NCH_2CH_2CH_2Si(OC_2H_5)_3$ $H_2NCONHCH_2CH_2Si(OCH_3)_3$ $H_2NCOHCH_2CH_2CH_2Si(OC_2H_5)_3$ $H_2NCH_2CH_2NHCH_2CH_2CH_2Si(OCH_3)_3$

The coated amount of the intermediate layer is preferably from 0.01 to 5 wt %, more preferably from 0.05 to 1 wt %, based on the weight of the carrier.

The intermediate layer can be provided, for example, by the following methods.

(1) Aqueous Solution Method

About from 0.1 to 0.5% of a coupling agent is dissolved sufficiently under stirring in water or in an aqueous solvent having predetermined pH, and then hydrolysis is carried out. After immersing the carrier core material in the resulting solution, water is removed by filtration or pressing, and the carrier core material is sufficiently dried by heating.

(2) Organic Solvent Method

A coupling agent is dissolved in an organic solvent (such as alcohol and benzene) containing a catalyst for hydrolysis (such as HCl and $CH_3COOH$) and a small amount of water. After immersing the carrier core material in the resulting solution, the organic solvent is removed by filtration or pressing, and the carrier core material is sufficiently dried by heating.

(3) Spray method

An aqueous solution or organic solvent solution of a coupling agent is sprayed to the carrier core material while vigorously stirring, and then heated to remove water or the organic solvent.

The graft copolymer used in the coated layers is obtained by graft-polymerizing a vinyl monomer to a polymer of a nitrogen-containing vinyl monomer or a phosphorus-containing vinyl monomer. The polymer of nitrogen-containing vinyl monomer (hereinafter referred to as "nitrogen-containing vinyl polymer") and the polymer of phosphorus-containing vinyl monomer (hereinafter referred to as "phosphorus-containing vinyl polymer") have a molecular weight of from 1,000 to 5,500, and preferably from 1,500 to 3,000. When the nitrogen-containing vinyl polymer and the phosphorus-containing vinyl polymer have a molecular weight higher than 5,500, the environmental dependence of the charge deteriorates and the charge build-up speed decreases. When the molecular weight is lower than 1,000, there are difficulties in manufacture, and deterioration occurs in the environmental dependence of the charge, the charge build-up speed and the charge exchangeability between toner and carrier.

The nitrogen-containing vinyl polymer or phosphorus-containing vinyl polymer having a molecular weight of from 1,000 to 5,500 used in the present invention can be obtained, for example, by copolymerizing a nitrogen-containing vinyl monomer or a phosphorus-containing vinyl monomer and a vinyl monomer capable of being copolymerized with the nitrogen-containing vinyl monomer or phosphorus-containing vinyl monomer.

Examples of the nitrogen-containing vinyl monomer include a dimethylaminoethyl methacrylate, a quaternarized product of dimethylaminoethyl methacrylate with an alkyl halide (such as, those having alkyl groups with carbon numbers of from 2 to 20, such as lauryl chloride and a stearyl halide), 2-vinylpyridine, 4-vinylpyridine, N-vinyl-2-pyrrolidone, morpholinoethyl methacrylate, and acryloyl morpholine. Among these, a dimethylaminoethyl methacrylate, 2-vinylpyridine, 4-vinylpyridine, N-vinyl-2-pyrrolidone, morpholinoethyl methacrylate, and acryloyl morpholine are preferably used, and a dimethylaminoethyl methacrylate is more preferred.

Examples of the phosphorus-containing vinyl monomer include a styryl phosphine monomer represented by formula:

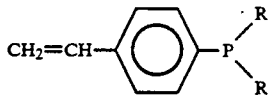

and a styryl phosphine oxide monomer represented by formula:

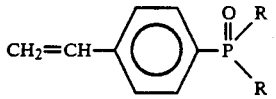

wherein R represents hydrogen, an alkyl group, an alkoxy group or an aromatic hydrocarbon group.

Examples of the vinyl monomer that is used for copolymerizing with the nitrogen-containing vinyl monomer or phosphorus-containing vinyl monomer include those having active groups for graft polymerization, such as glycidyl acrylate and glycidyl methacrylate.

The amount of the monomer having active groups for graft polymerization is generally from 0.1 to 20 wt %, preferably from 0.3 to 10 wt %, more preferably from 0.5 to 5 wt %, based on the copolymer.

Examples of the vinyl monomer that is used for graft-polymerizing with the active groups of the nitrogen-containing vinyl polymer or phosphorus-containing polymer include an acrylate and a methacrylate. Examples of the alcohol components of these esters include alkyl alcohols such as methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol and hexadecyl alcohol; alkoxyalkyl alcohols obtained by alkoxylating these alkyl alcohols such as methoxyethyl alcohol, ethoxyethyl alcohol, ethoxyethoxyethyl alcohol, methoxypropyl alcohol and ethoxypropyl alcohol; aralkyl alcohols such as benzyl alcohol, phenylethyl alcohol and phenylpropyl alcohol; and alkenyl alcohols such as allyl alcohol and crotonyl alcohol. Preferred examples of the vinyl monomer used for graft-copolymerization include an alkyl acrylate and an alkyl methacrylate.

In the present invention, other vinyl monomers may be graft-copolymerized in combination with the above vinyl monomers that are graft-copolymerized to the nitrogen-containing vinyl polymer or phosphorus-containing vinyl polymer. Examples of these other vinyl monomers include styrene; alkyl styrenes such as dimethyl styrene, trimethyl styrene, ethyl styrene, diethyl styrene, triethyl styrene, propyl styrene, butyl styrene, hexyl styrene, heptyl styrene and octyl styrene; halogenated styrenes such as fluorostyrene, chlorostyrene, bromostyrene, dibromostyrene and iodostyrene; other styrene monomers such as nitrostyrene, acetyl styrene and methoxystyrene; addition-polymerizable unsaturated aliphatic monocarbonic acids such as acrylic acid, methacrylic acid, α-ethyl acrylic acid, crotonic acid, α-methyl crotonic acid, α-ethyl crotonic acid, isocrotonic acid, tiglic acid and ungerica acid; addition-polymerizable unsaturated aliphatic dicarbonic acids such as maleic acid, fumaric acid, itaconic acid, citraconic acid, mesaconic acid, gluconic acid and dihydromuconic acid; esters, amides and nitryls of the above carbonic acids other than acrylates and methacrylates; aliphatic monolefins such as ethylene, butene and isobutylene; and a halogenated alphatic olefins such as vinyl chloride, vinyl iodide, 1,2-dichloroethylene, 1,2-bromoethylene, 1,2-iodoethylene, isopropenyl chloride, isopropenyl bromide, allyl chloride, allyl bromide, vinylidene chloride, vinyl fluoride and vinylidene fluoride.

Among the above, preferred examples of the combination of the vinyl monomers used for graft polymerization include copolymers of styrene and (meth)acrylate having a copolymerization ratio (styrene/acrylate) of from 60/40 to 95/5.

The proportion (copolymerization ratio) of the nitrogen-containing vinyl monomer or phosphorus-containing vinyl monomer in the graft copolymer of the present invention is generally from 1 to 10 wt % based on the total amount of the graft copolymer, and preferably in the range of from 1 to 5 wt %. When the proportion of the nitrogen-containing vinyl monomer or phosphorus-containing vinyl monomer is lower than 1 wt %, the absolute amount of the charge tends to become lower causing toner contamination inside the copier. When it is larger than 10 wt %, the absolute amount of the charge tends to become higher than its proper range, particularly under low temperature and low humidity, causing a drop in image density.

The graft copolymer formed by graft polymerization on the above nitrogen-containing vinyl polymers or phosphorus-containing vinyl polymers with a vinyl monomer generally has a number average molecular weight of from 10,000 to 200,000, and preferably from 50,000 to 100,000. When the number average molecular weight is lower than 10,000, the coated layers tend to peel off from the core material inside the copier. When it is higher than 200,000, it tends to be difficult to coat the core material.

The graft copolymer can be produced by conventional methods such as solution polymerization of the vinyl monomer with the nitrogen-containing vinyl polymers or phosphorus-containing vinyl polymers.

In the present invention, the coated layers may be formed by the above graft copolymer only, or they may be formed by mixtures with a fluorine-containing polymer.

In the case where the coated layer is formed by a mixture of the graft copolymer and a fluorine-containing polymer, the coated layer generally has such a structure that the surface region of the layer has a high concentration of fluorine-containing polymer, while the intermediate region between the surface region and the surface of the carrier core material has a high concetration of the nitrogen-containing graft copolymer.

The above structure of the coated layer can be found by analyzing the elemental distribution of the coated layer along the depth direction by an argon ion etching method using electron spectroscopy for chemical analysis (ESCA). That is, upon subjecting the coated layer to argon ion etching, fluorine atoms are detected but nitrogen atoms are not detected in the initial stage, and after few seconds, fluorine atoms cannot be detected and the concentration of nitrogen atoms increases. Therefore, when a fluorine-containing polymer and the nitrogen-containing graft copolymer are used in combination as the coated layer, a region having a high concentration of the fluorine-containing polymer is formed near the surface of the carrier, and a region having a high concentration of the nitrogen-containing graft copolymer is formed under the region having a high concentration of the fluorine-containing polymer.

In the case where the coated layer has the above structure, the carrier is excellent in charge maintenance property and charge imparting property to toner. It is considered that this is because the functions of the low surface energy of the fluorine-containing polymer and the charge imparting property of the nitrogen-containing graft copolymer act separately.

Examples of the fluorine-containing polymers that can be used include copolymers of perfluoroctyl methacrylate and alkyl methacrylate, homopolymers of polytetrafluoroethylene, polyvinylidene fluoride or polychlorotrifluoroethylene, or copolymers of these fluorine-containing monomers with an alkyl methacrylate. The proportion of the graft copolymer is generally at least 20 wt %, and preferably from 20 to 80 wt %, based on the total amount of the graft copolymer and the fluorine-containing polymer.

Examples of methods of forming the coated layers of the graft copolymers on the surfaces of the core materials include: the dipping method of immersing the core material in a coated layer forming solution; the spray method of spraying the coated layer forming solution on the surfaces of the core material; the fluid bed method of spraying the coated layer forming solution in a state where the core material is suspended by fluid air; and the kneader-coat method of mixing the core material and the coated layer forming solution in a kneader-coater and then removing a solvent.

There are no particular restrictions as to the solvent used in the coated layer forming solution as long as it dissolves the graft copolymer. Examples of the solvents include aromatic hydrocarbons such as toluene and xylene, ketones, such as acetone and methyl ethyl ketone, and ethers such as tetrahydrofuran and dioxane.

The thickness of the coated layers is generally from 0.1 to 10 μm, and preferably from 0.3 to 5 μm.

The mechanism of the functions realized in the present invention cannot always be satisfactorily elucidated, but it is considered that the graft copolymer that constitute the coated layers has a higher charge mobility compared to a random copolymer, and displays a sufficient capacity to charge the toner negatively.

The present invention will next be explained in further detail by means of the following examples, but the present invention is not construed as being limited thereto.

EXAMPLE 1

99 parts by weight of dimethylaminoethyl methacrylate (hereafter called "DMAEM") and 1 part by weight of glycidyl methacrylate were polymerized in toluene to obtain a DMAEM polymer having a molecular weight of 3,000. Graft polymerization was next carried out by adding styrene and methyl methacrylate to the DMAEM polymer to obtain a graft copolymer having a copolymerization ratio of DMAEM/styrene/methyl methacrylate of 2/20/78 by weight. The number average molecular weight of this graft copolymer was 20,000 and the weight average molecular weight was 100,000.

The core material used was a Cu-Zn ferrite carrier having an average particle diameters of 120 μm ("F-100" made by Powdertech Co. Ltd.). A coating layer forming solution having a concentration of 15% obtained by dissolving the graft copolymer in toluene was added to the core material in such a manner that the graft copolymer was 1.2 parts by weight per 100 parts by weight of the core material, so as to make a coated carrier having coated layers having a thickness of 0.25 μm. (Carrier 1)

A coated carrier for comparison was obtained in the same manner as in Carrier 1 except that a random copolymer having the same copolymerization ratio was used instead of the graft copolymer of Carrier 1. (Carrier 2)

The above Carriers 1 and 2 each was mixed with a toner obtained as described below in a weight ratio of 97/3 to make developer compositions, and the following evaluations were performed.

| Toner Preparation | |
|---|---|
| Polyester resin "Plastech S-1000" made by Dainippon Ink & Chemicals | 95 parts by weight |

-continued

| Toner Preparation | |
|---|---|
| Co., Ltd.) | |
| Carbon Black ("#4000" made by Mitsubishi Chemical Co., Ltd.) | 5 parts by weight |

The above components were kneaded in an extruder, and the mixture was pulverized by a jet mill and classified by a wind classifier so as to obtain a toner having an average particle diameter of 9 μm.

Amorphous titania having an average particle diameter of 15 nm "Ultrafine Powder" made by Idemitsu Kosan Co. Ltd.) (the product was made hydrophobic by treating the surfaces with a low molecular silane coupling agent) was added, and mixed in a Henschel mixer. Further, the addition amount of amorphous titania was an amount that gave 100% coverage of the toner surfaces.

METHOD OF EVALUATING THE DEVELOPER COMPOSITION

1. Absolute Charge Amount

After mixing the toner with the carrier, the blow-off charge amount was measured after three minutes (μC/g)

2. Environmental Dependence of The Charge $$\frac{\text{Charge at 28° C., 85\% RH}}{\text{Charge at 10° C., 15\% RH}}$$

3. Charge Build-up Speed

The developer composition was shaken in a paint shaker to evaluate the ratio of the amounts of charge after one minute and after 10 minutes of shaking.

$$\text{Charged build-up speed} = \frac{\text{Charge at 1 minute}}{\text{Charge at 10 minutes}}$$

4. Charge Exchangeability Between Toner And Carrier

After shaking the developer composition for 60 minutes in a paint shaker, the toner only was newly added, and the charge distribution after continued shaking for five seconds in the paint shaker was measured with a CSG measuring instrument.

The results are shown in Table 1.

TABLE 1

| Carrier | Charge Environment Dependence | Charge Build-up Speed | Toner-Carrier Charge Exchangeability |
|---|---|---|---|
| Carrier 1 | 0.80 | 0.66 | Sharp Charge Distribution |
| Carrier 2 | 0.41 | 0.41 | Broad Charge Distribution |

It is understood from the results in Table 1 that the carrier according to the present invention is excellent in all of the charge environment dependence, the charge build-up speed and the toner-carrier charge exchangeability, and thus has good chargeability.

EXAMPLE 2

Coated carriers were obtained in the same manner as in Carrier 1 of Example 1, except that the proportions and the molecular weights of the DMAEM polymer were varied as shown below in Table 2. (Carriers 3 to 11)

TABLE 2

| Carrier | DMAEM Copolymer Proportions (wt %) | DMAEM Polymer Molecular Weight |
|---|---|---|
| Carrier 3 | 2 | 1,500 |
| Carrier 4 | 2 | 5,000 |
| Carrier 5 | 2 | 8,000 |
| Carrier 6 | 10 | 1,500 |
| Carrier 7 | 10 | 5,000 |
| Carrier 8 | 10 | 8,000 |
| Carrier 9 | 20 | 1,500 |
| Carrier 10 | 20 | 5,000 |
| Carrier 11 | 20 | 8,000 |

Developer compositions were prepared for these carriers in the same manner as in Example 1, and evaluations were made in the same way. The results are shown in Table 3.

TABLE 3

| Carrier | Charge Environment Dependence | Charge Build-up Speed | Toner-Carrier Charge Exchangeability |
|---|---|---|---|
| Carrier 3 | 0.82 | 0.65 | Sharp Charge Distribution |
| Carrier 4 | 0.61 | 0.85 | Sharp Charge Distribution |
| Carrier 5 | 0.22 | 1.32 | Sharp Charge Distribution |
| Carrier 6 | 0.55 | 0.67 | Sharp Charge Distribution |
| Carrier 7 | 0.50 | 0.80 | Sharp Charge Distribution |
| Carrier 8 | 0.13 | 1.20 | Sharp Charge Distribution |
| Carrier 9 | 0.35 | 0.70 | Sharp Charge Distribution |
| Carrier 10 | 0.20 | 0.82 | Sharp Charge Distribution |
| Carrier 11 | 0.10 | 1.30 | Sharp Charge Distribution |

It is understood from the results in Table 3 that carriers having further excellent chargeability can be obtained when the DMAEM polymerization ratio is 10 wt % or less and the DMAEM polymer molecular weight is 5,000 or less.

EXAMPLE 3

Using the same monomer as in Example 1 and with the same polymerization method, a graft copolymer having a DMAEM polymerization ratio of 2 wt % and a DMAEM polymer molecular weight was 3,000 was prepared.

A copolymer of perfluoroctyl methacrylate and methyl methacrylate (copolymerization ratio: 40/60 by weight, "LP-15", made by Soken Chemical Co. Ltd.) (number average molecular weight Mn: 20,000, weight average molecular weight Mw: 50,000) was used as a fluorine polymer. Coated carriers were obtained in the same manner as in Example 1 except that coated layer forming solutions were prepared by mixing the graft copolymer and the fluorine polymer in the proportions shown in Table 4. (Carriers 12 to 16)

Several tens of particles of the above-obtained carrier were placed on the surface of an adhesive tape while preventing the formation of gaps between the carrier particles. The carrier was subjected to argon ion etching at 0.5 kV×8 mA, and the amounts of elements present at the surface of the carrier were counted by ESCA and plotted along the depth direction of the coated layer.

At the beginning of etching, the count of fluorine atom was about 6,000 and the count of nitrogen atom was lower than the measurement limit. After 5 seconds from the beginning of etching, the count of fluorine atom decreased to the level lower than the measurement limit and the count of nitrogen atom increased to about 1,000. By continuing the etching process for 1 minute and 10 seconds, these levels of elemental distribution at 5 seconds after were maintained.

The above obtained carriers were used to prepare developer compositions in the same manner as in Example 1, and running tests were carried out for 5,000 copies with a copier ("FX-5030", made by Fuji Xerox Co., Ltd.). The results are shown in Table 4.

TABLE 4

| Carrier | Mixture Ratio (Nitrogen-containing Copolymer/ Fluorine Polymer (wt %) | Initial Charge Amount (μC/g) | Charge Amount After 5,000 Copies (μC/g | Fogging In Non-image Portions After 5,000 Copies | Carrier Surface Evaluation (SEM) After 5,000 Copiers |
|---|---|---|---|---|---|
| 12 | 10/90 | −18.3 | −9.3 | High | Peeling in cover layers |
| 13 | 20/80 | −20.9 | −17.4 | None | No changes |
| 14 | 50/50 | −25.1 | −24.8 | None | No changes |
| 15 | 80/20 | −18.3 | −21.5 | None | No changes |
| 16 | 90/10 | −33.1 | −11.2 | High | Much adhesion of additives of toner |

It is understood from the results in Table 4 that carriers having further excellent chargeability can be obtained when the proportion of the graft copolymer is from 20 to 80 wt % based on the total amount of the graft copolymer and the fluorine-containing polymer.

EXAMPLE 4

To 100 parts by weight of $CuO$-$ZnO$-$Fe_2O_3$ ("F-100", made by Powdertech Co. Ltd.) as the core material, a methanol solution of 0.1 part by weight of γ-aminopropyltriethoxysilane was added. After mixing in a kneader, the methanol was evaporated, and it was heated for two hours at 120° C. to completely harden the γ-aminopropyltriethoxysilane. A coated layer was formed on the thus treated core material by the same method as for Carrier 14 in Example 3 using a coated layer forming solution to obtain a coated carrier. (Carrier 17)

Evaluations were made using the two toners below.

1) Toner 1

The toner described in Example 1

2) Toner 2

Toner made in the same manner as the toner described in Example 1 except for using "Pigment Red C.I. 122" (dimethyl quinacridone, made by DIC Co. Ltd.) instead of carbon black Developer compositions were prepared by mixing Toner 1 or Toner 2 with Carrier 17 in the same manner as in Example 1, and running tests were carried out for 5,000 copies with a copier ("FX-5030", made by Fuji Xerox Co. Ltd.). The results are shown in Table 5.

TABLE 5

| Developer Composition | | | | | | |
|---|---|---|---|---|---|---|
| No. | Toner | γ-Aminopropyl triethoxy silane Treatment Amount (wt %)* | Initial Charge Amount (μC/g) | Charge Amount After 5,000 Copies (μC/g) | Fogging In Non-image Portions After 5,000 Copies | Image Density After 5,000 Copies** |
| A | Toner 1 | 0 | −25.1 | −24.8 | None | A |
| B | Toner 1 | 0.1 | −32.1 | −30.0 | None | B |
| C | Toner 1 | 0.5 | −38.1 | −36.7 | Found | B |
| D | Toner 2 | 0 | −5.4 | −2.5 | Found | B |
| E | Toner 2 | 0.1 | −15.0 | −11.3 | None | A |
| F | Toner 2 | 0.5 | −25.8 | −23.9 | None | A |

*Weight percent based on the weight of the carrier core material
**A: Reproduced density, the original density at which is 1.2, is 0.9 or more.
B: Reproduced density, the original density at which is 1.2, is less than 0.9.

As is apparent from Table 5, it is possible to vary the carrier charge amount according to the amount of γ-aminopropyltriethoxysilane treatment. As a result, it becomes possible to make developer compositions having the desired absolute amounts of charge without controlling the charge capacity of the corresponding toners. That is, it is possible to make toner compositions having the desired amount of charge even in the case of Toner 2 which has a strongly positive charge capacity. Further, since the stability of the charge over time depends on the coated layer, the product obtained has superior stability over time.

The carrier for magnetic brush developer of the present invention, because it has the above described construction, has superior surface contamination resistance, good environmental dependence of charge, a fast charge build-up speed and superior charge exchangeability. Consequently, it has the required high amount of negative charge even when used rapidly over long time periods, and high quality copy images can be obtained without background contamination and image flow.

While the invention has been described in detail and with reference to specific examples thereof, it will be apparent to one skilled in the art that various changes and modifications can be made therein without departing from the spirit and scope thereof.

What is claimed is:

1. A carrier for magnetic brush developer comprising a core material having coated thereon a coated layer containing a graft copolymer comprising a polymer of a nitrogen-containing vinyl monomer or a phosphorus-containing vinyl monomer having a molecular weight of from 1,000 to 5,500 graft-copolymerized thereto a vinyl monomer and wherein the copolymer proportions of said nitrogen- containing vinyl monomer or phosphorus- containing vinyl monomer are from 1 to 10 wt % based on the total amount of said graft copolymer.

2. A carrier for magnetic brush developer as claimed in claim 1, wherein an intermediate layer is provided between said core material and said coated layer, said intermediate layer comprising a nitrogen-containing silane coupling agent represented by formula (I):

$$R\text{-}Si(OX)_3 \quad (I)$$

wherein X represents a hydrolyzable group, and R represents an alkyl group containing 3 or more of carbon atoms and 1 or more nitrogen atoms.

3. A carrier for magnetic brush developer as claimed in claim 1, wherein the thickness of said coated layer is from 0.1 to 10 μm.

4. A carrier for magnetic brush developer as claimed in claim 1, wherein the number average molecular weight of said graft copolymer is from 10,000 to 200,000.

5. A carrier for magnetic brush developer as claimed in claim 1, wherein said coated layer further comprises a fluorine-containing polymer, and wherein the resin mixture ratio of said copolymer to fluorine polymer is from 80/20 to 20/80 by weight.

6. A carrier for magnetic brush developer comprising a core material having coated thereon a coated layer containing (1) a graft copolymer comprising a polymer of a nitrogen-containing vinyl monomer or a phosphorus-containing vinyl monomer having a molecular weight of from 1,000 to 5,500 graft-copolymerized thereto a vinyl monomer and (2) a fluorine-containing polymer, said coated layer having such a structure that the surface region of said coated layer has a high concentration of said fluorine-containing polymer, and wherein the resin mixture ratio of said copolymer to fluorine polymer is from 80/20 to 20/80 by weight.

* * * * *

UNITED STATES PATENT AND TRADEMARK OFFICE

CERTIFICATE OF CORRECTION

PATENT NO. : 5,202,210
DATED : April 13, 1993
INVENTOR(S) : Hirotaka Matsuoka et al.

It is certified that error appears in the above-indentified patent and that said Letters Patent is hereby corrected as shown below:

Claim 1, column 11, line 2, delete "and".

Claim 1, column 11, line 3, change "nitrogen-containing" to --nitrogen-containing--.

Claim 1, column 11, lines 3 and 4, change "phosphorus- containing" to --phosphorus-containing--.

Signed and Sealed this
Fifth Day of April, 1994

Bruce Lehman

*Attest:*

BRUCE LEHMAN

*Attesting Officer*

*Commissioner of Patents and Trademarks*